US008099286B1

(12) United States Patent
Thommana et al.

(10) Patent No.: US 8,099,286 B1
(45) Date of Patent: Jan. 17, 2012

(54) SYSTEM AND METHOD FOR PROVIDING SITUATIONAL AWARENESS ENHANCEMENT FOR LOW BIT RATE VOCODERS

(75) Inventors: John Thommana, Cedar Rapids, IA (US); Lizy Paul, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 903 days.

(21) Appl. No.: 12/152,187

(22) Filed: May 12, 2008

(51) Int. Cl.
*G10L 21/00* (2006.01)
*G10L 13/00* (2006.01)
*G10L 21/06* (2006.01)

(52) U.S. Cl. ..... 704/274; 704/270; 704/258; 704/276

(58) Field of Classification Search ..... None
See application file for complete search history.

(56) References Cited

U.S. PATENT DOCUMENTS 7,707,035 B2 * 4/2010 McCune ..... 704/270
7,831,433 B1 * 11/2010 Belvin et al. ..... 704/275
7,876,903 B2 * 1/2011 Sauk ..... 381/17
2007/0071206 A1 * 3/2007 Gainsboro et al. ..... 379/168
2007/0136218 A1 * 6/2007 Bauer et al. ..... 706/12
2007/0183604 A1 * 8/2007 Araki et al. ..... 381/58
2008/0162110 A1 * 7/2008 Mergen et al. ..... 704/2
2008/0300871 A1 * 12/2008 Gilbert ..... 704/233
2009/0207247 A1 * 8/2009 Zampieron et al. ..... 348/143
2009/0248398 A1 * 10/2009 Aviran et al. ..... 704/9
2009/0299924 A1 * 12/2009 Bauer et al. ..... 706/12
2010/0001902 A1 * 1/2010 Smith ..... 342/357.07
2010/0030400 A1 * 2/2010 Komer et al. ..... 701/3

* cited by examiner

*Primary Examiner* — Talivaldis Ivars Smits
(74) *Attorney, Agent, or Firm* — Donna P. Suchy; Daniel M. Barbieri

(57) ABSTRACT

Situational awareness enhancement is promoted in a radio communication transceiver receiving non-verbal content and verbal content from a remote source. A vocoder communicatively coupled with the transceiver receives the verbal content packets, and a situational awareness encoder/decoder communicatively coupled with the transceiver receives the non-verbal content packets. The encoder/decoder links and synchronizes the verbal content packets with the corresponding non-verbal content packets, and provides the verbal content packets to the vocoder in parallel with the provision of the non-verbal content packets to the encoder/decoder. The non-verbal and verbal content is extracted from the respective packets and are synchronously output for display and playback, respectively.

11 Claims, 3 Drawing Sheets

SYSTEM AND METHOD FOR PROVIDING SITUATIONAL AWARENESS ENHANCEMENT FOR LOW BIT RATE VOCODERS

FIELD OF THE INVENTION

The present invention relates to the field of communication devices and particularly to a system and method for providing situational awareness enhancement for low bit rate vocoders.

BACKGROUND OF THE INVENTION

A number of currently available low bit rate vocoders provide an optimized speech coding engine which allows for the hosting of intelligible speech communication in extremely low bandwidth. However, these currently available low bit rate vocoders also introduce a number of shortcomings (ex. —distortion) with respect to the exchange of support information (ex. —non-verbal communication signals) and consequently, may provide a less than desired level of situational awareness.

Thus, it would be desirable to provide a communication solution which obviates the above-referenced problems associated with currently available low bit rate vocoders.

SUMMARY OF THE INVENTION

Accordingly, an embodiment of the present invention is directed to a system for promoting situational awareness enhancement, including: a transceiver configured for receiving a non-verbal content packet and a verbal content packet, both the non-verbal content packet and the verbal content packet being transmitted from a remote source; a vocoder communicatively coupled with the transceiver, the vocoder being configured for receiving the verbal content packet from the transceiver, the vocoder being further configured for extracting verbal content from the verbal content packet; and a situational awareness encoder/decoder communicatively coupled with the transceiver, the encoder/decoder being configured for receiving the non-verbal content packet from the transceiver, the encoder/decoder being further configured for extracting non-verbal content from the non-verbal content packet.

An additional embodiment of the present invention is directed to a method for promoting situational awareness enhancements for a low bit rate vocoder, including: receiving communication content via an audio input device; providing non-verbal content included in the communication content to an encoder/decoder; providing verbal content included in the communication content to the vocoder; and creating a local non-verbal content packet based on the non-verbal content of the communication content and creating a local verbal content packet based on the verbal content of the communication content.

A further embodiment of the present invention is directed to a computer-readable medium having computer-executable instructions for performing a method for promoting situational awareness enhancements for a low bit rate vocoder, said method comprising: receiving communication content via an audio input device; providing non-verbal content included in the communication content to an encoder/decoder; providing verbal content included in the communication content to the vocoder; and creating a local non-verbal content packet based on the non-verbal content of the communication content and creating a local verbal content packet based on the verbal content of the communication content.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
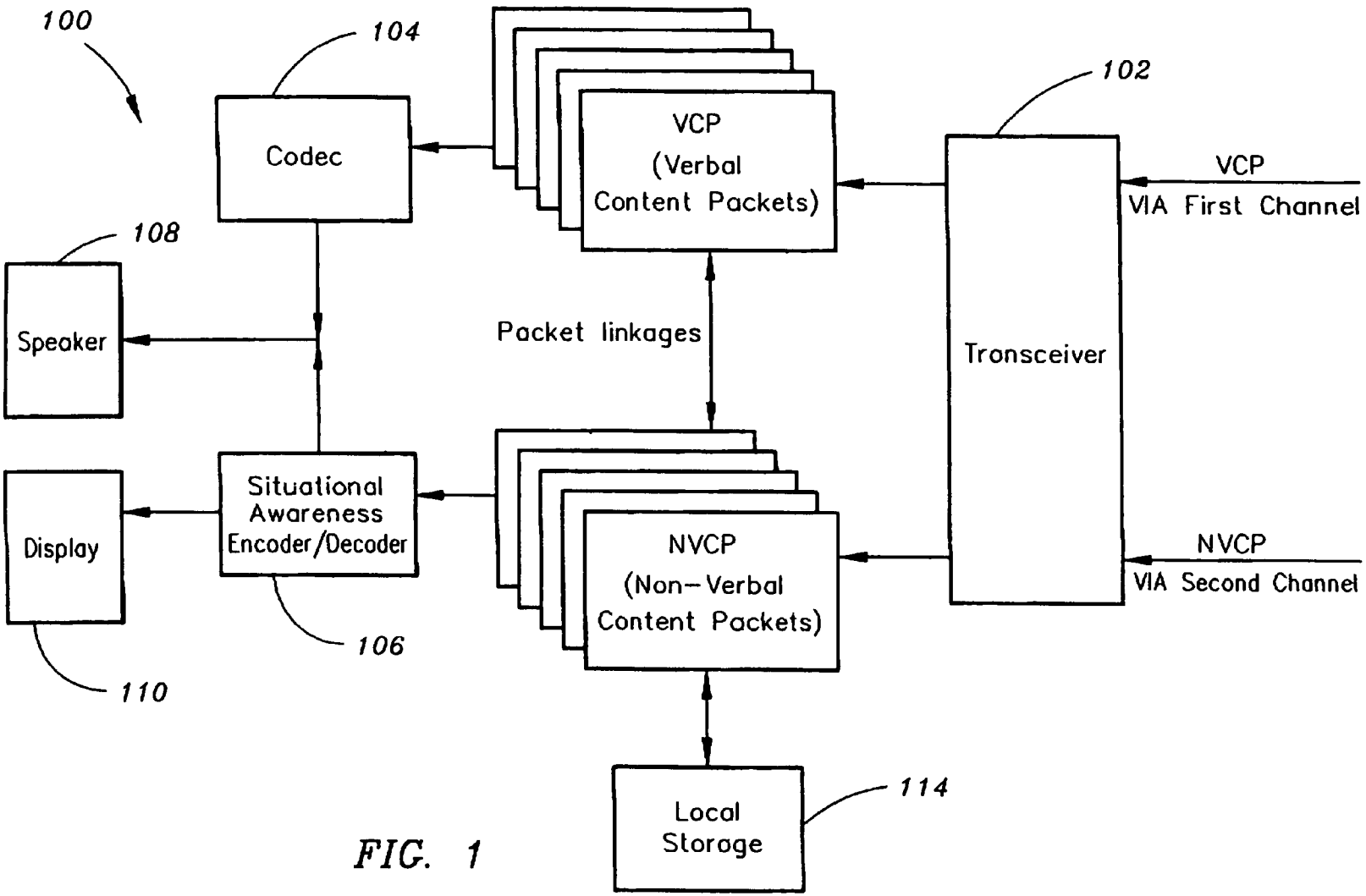
FIG. 1 is a block diagram of a system for promoting situational awareness enhancement in accordance with an exemplary embodiment of the present invention in which the system is receiving transmitted non-verbal content packets and verbal content packets on separate channels from a remote source.

A number of low bit rate vocoders/audio codecs (coder/decoders), such as 1.2 kilobits per second (kbps)/2.4 kbps MELPe (Mixed Excitation Linear Prediction enhanced) codecs, provide an optimized speech analyzing engine for specifically addressing the content, nuances and inflections of human voice. Such optimization has successfully allowed for the hosting of intelligible speech communication in extremely low bandwidth, but has introduced a series of shortcomings in the exchange of support information (ex. —non-verbal communication/non-verbal surrounding information/non-verbal signals). For instance, an emergency responder (ex. —tactical and support) who is receiving an emergency radio communication (ex. —such as via a handheld radio or vehicle-mounted radio) from a remotely-located party may rely on non-verbal surrounding information/sounds which are caused by events occurring in the vicinity of the remotely-located party and are heard via the radio communication to determine the rate of response to the emergency/the degree of urgency of the emergency/if someone has responded to the emergency, etc. Non-verbal surrounding information/sounds may include gun shots, vehicle backfire noise, motorboat motors, sirens, or the like which are occurring in the vicinity of the remotely-located party (ex. —in the vicinity of/at the site of the emergency). Such non-verbal information may be valuable in that it may enhance/supplement the verbal content (ex. —the words spoken by the remotely located party) of the radio communication by providing non-verbal signs that help to describe the scene and/or situation at the remote (ex. —emergency) location, which may help the emergency responder better understand and better respond to the emergency.

The above-referenced optimization of codecs/vocoders for facilitating low bit rate speech communication often causes such non-verbal information to be excluded or distorted so that it is not recognizable/distinguishable/detectable by the listening party (ex. —the emergency responder) during the radio communication. Such exclusion or distortion may allow for misreading or mishandling of emergency situations by the emergency responder. This may be problematic not only for emergency responders, but may also become a tactical communication problem. For example, when such non-verbal information is not provided in a recognizable manner, a soldier deployed in an emergency location (ex. —in the field) may have to spend valuable time and effort verbally updating/describing the gravity of a situation at his/her location (ex. —the emergency location) to the responder. However, if such non-verbal information had been provided in a recognizable manner, the situation at the emergency location may have been more readily ascertained by the responder (ex. —may promote improved situational awareness), which may have spared the soldier from having to provide the extensive verbal updates/descriptions.

The present invention proposes a low bit rate speech communication solution which allows for transmission of non-verbal information in a manner which enhances situational awareness.

Reference will now be made in detail to the presently preferred embodiments of the invention, examples of which are illustrated in the accompanying drawings.

Figure 2:
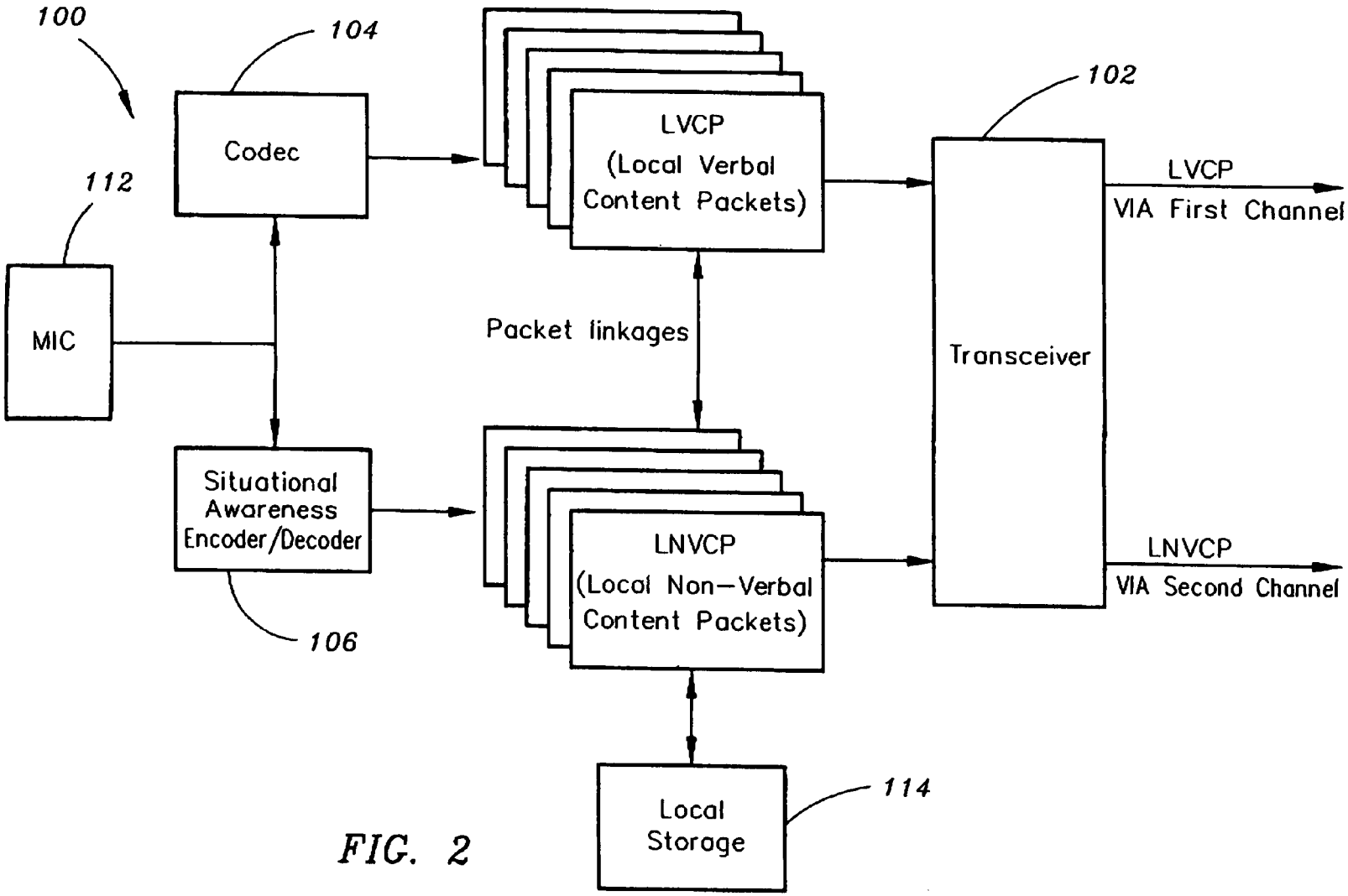
FIG. 2 is a block diagram of the system shown in FIG. 1 in which the system is transmitting local non-verbal content packets and local verbal content packets to a remote source via separate channels in accordance with an exemplary embodiment of the present invention.

Referring generally to FIGS. 1 and 2, a system for promoting situational awareness enhancement in accordance with an exemplary embodiment of the present invention is shown. For example, the system 100 may be a radio communication device, such as a handheld radio, a vehicle-mounted radio, a mobile radio, an on-board radio (ex. —an on-board radio which is implemented on-board a airplane, ship, train, etc.) or the like. In exemplary embodiments, the system 100 may include a transceiver 102. The transceiver 102 may be configured for receiving non-verbal content packets and verbal content packets which have been transmitted/streamed as a data stream from a remote source (such as via a radio communication from a remotely-located radio device).

In further embodiments, the system 100 may include a vocoder/audio codec 104. For instance, the vocoder 104 may be a low bit rate vocoder, such as a 1.2 kbps codec and/or a 2.4 kbps MELPe codec. The vocoder 104 may be communicatively coupled with the transceiver 102. The vocoder 104 may be configured for receiving the verbal content packet(s) from the transceiver 102 and for extracting/re-creating/synthesizing verbal content from the verbal content packet(s). Verbal content may include/be defined as speech/audible speech which is provided by one or more parties during a radio communication.

In current embodiments of the present invention, the system 100 may include a situational awareness encoder/decoder 106. The encoder/decoder 106 may be communicatively coupled with the transceiver 102. Further, the encoder/decoder 106 may be configured for receiving the non-verbal content packet(s) from the transceiver 102 and for extracting/re-creating/synthesizing non-verbal content from the non-verbal content packet(s). As discussed above, non-verbal content may include sounds/non-spoken sounds which are occurring in the vicinity of the party/parties during the radio communication, such as gun shots, vehicle backfire noise, motorboat motors, sirens, etc. In additional embodiments, the encoder/decoder 106 may be communicatively coupled with the vocoder 104.

In exemplary embodiments of the present invention, the system 100 may include an audio output device 108 (FIG. 1), such as a speaker. The audio output device 108 may be communicatively coupled with/connected to the vocoder 104 and the encoder/decoder 106. Further, the audio output device 108 may be configured for providing an audio output based on the extracted non-verbal content and the extracted verbal content. For instance, the speaker 108 may provide an audio output (which may be audible to a user in the vicinity of the system 100) which includes/is based upon the verbal content (ex. —the audible speech) provided by a remotely-located party during the radio communication, and also includes/is based upon the non-verbal content (ex. —the non-spoken, audible sounds/noises) occurring in the vicinity of the remotely-located party during the radio communication.

In additional embodiments of the present invention, the system 100 may include a visual output device 110 (FIG. 1). The visual output device 110 may be communicatively coupled with/connected to the encoder/decoder 106. For example, the visual output device 110 may be a television monitor, a graphical display screen, or the like. Further, the visual output device 110 may be configured for providing a text output based on the extracted non-verbal content. In additional embodiments, the encoder/decoder 106 may be a wideband traditional Hidden Markov Model (HMM) detector or a cyclostationary feature detector which is configured for categorizing/classifying/identifying the non-verbal content of the non-verbal content packets. For instance, the encoder/decoder 106 may be configured for identifying signals of interest included in the non-verbal content, such as gunfire, vehicle noises or sirens. Additionally, the encoder/decoder 106 may be configured for distinguishing/identifying the signals of interest to a greater degree of particularity, such as identifying a gunshot signal as being a rifle shot or a pistol shot, or identifying a siren as being a police siren, ambulance siren, or the like. Further, the encoder/decoder 106 may be configured for determining proximity, direction of arrival, and/or other useful information pertaining to the signals included in the non-verbal content for gauging usefulness of the signals. As discussed above, the visual output device 110 may be configured for providing a text output based on the extracted non-verbal content, and said text output may provide information about/describe the signals included in the non-verbal content to any one or more of the varying degrees of particularity described above.

In current embodiments of the present invention, the system 100 may further include an audio input device 112 (FIG. 2). The audio input device 112 may be communicatively coupled to the vocoder 104 and the encoder/decoder 106. Further, the audio input device 112 (ex. —a microphone) may be configured for receiving communication content (which may include verbal content and/or non-verbal content) from a user. For example, a user who is located proximally to the system 100 may speak into the microphone 112 during a radio communication, thus, the microphone 112 may be configured for receiving verbal content (ex. —audible speech/speech content) from the user. Additionally, the microphone 112 may be configured for receiving non-verbal content (ex. —sirens, gunshots, vehicle noises) which is present in the vicinity of the user (and the system 100) when the user is making a radio communication.

In exemplary embodiments of the present invention, the vocoder 104 is configured for receiving the verbal content included in the communication content. Further, the encoder/decoder 106 is configured for receiving non-verbal content included in the communication content. The vocoder 104 is further configured for generating a local verbal content packet, the local verbal content packet being based on the verbal content of the communication content. The encoder/decoder 106 is further configured for generating a local non-verbal content packet, the local non-verbal content packet being based on the non-verbal content of the communication content.

In further embodiments, the transceiver 102 is further configured for transmitting the local non-verbal content packet and the local verbal content packet via radio communication, such as to a remotely located party.

In additional embodiments, the system 100 may be configured for linking the local non-verbal content packet and the local verbal content packet. For instance, the local non-verbal content packet may correspond with local verbal content packet such that they include non-verbal content and verbal content respectively which occurred concurrently during the user's radio communication. For example, the non-verbal content may be noises, such as sirens, etc. which were present in the vicinity of the user and received by the microphone during a radio communication in which the user's speech was also received by the microphone. By linking the corresponding packets, the system 100 of the present invention may provide/transmit local non-verbal content packets and local verbal content packets which are synchronized (ex—based on when their content occurred) for promoting ease of synchronized playback and/or display of outputs based on said content included in the packets when said packets are transmitted to a remote device.

In further embodiments, the system 100 may be further configured for linking verbal content packets and the non-verbal content packets which are received via transmission from a remote source. Linking associated verbal content packets and non-verbal content packets, such as described above, may promote synchronized playback and/or display (via the speaker 108 and/or display 110 of the system 100. For instance, due to said linking capabilities of the system 100 of the present invention, a user may be able to listen to an audio output (via the speaker 108) which is based on the extracted verbal and non-verbal content, while also being able to view a text message, scrolling caption, or the like (via the display 110) which describes/provides information about the non-verbal content (ex. —"pistol fire in the background, distance 30 ft. from communicating party") which is heard via the speaker.

In current embodiments, the linking of packets as described above may include creating timestamp linkage(s) for the packets. In further embodiments, the encoder/decoder 106 may include/incorporate packet synchronizers for providing packet linking capabilities and promoting synchronized playback/display. In further embodiments, the system 100 may be configured for creating text/Extensible Markup Language (XML)-based packets and tagging them to non-verbal content packets, local non-verbal content packets, verbal content packets, and/or local verbal content packets. In further embodiments, the encoder/decoder 106 may be a neural network-based signal classifier.

In further embodiments, the system 100 may be configured such that local non-verbal content packets, local verbal content packets, non-verbal content packets, and/or verbal content packets may be transmitted and/or received (ex. —as/via a data stream) on different radio channels with differing levels of protection, such as when the system 100 is a multi-channel radio. For instance, non-verbal content packets may be received by the system 100 via a situational awareness channel. A number of newer networking waveforms (ex. —Mobile User Objective Systems (MUOS) support multiple data streams simultaneously.

In additional embodiments, the system 100 may include a storage device 114. The storage device 114 may be communicatively coupled with/connected to the transceiver 102, the encoder/decoder 106, and/or the vocoder 104. The storage device 114 may be configured for storing local non-verbal content packets, local verbal content packets, non-verbal content packets, verbal content packets, extracted verbal content, and/or extracted non-verbal content to be played, replayed and/or transmitted to a remote party at a later time. The system 100 may be configured for providing an indication to a user, recipient, and/or remotely located party that said packets are being stored by the system 100 and available upon demand. The above-referenced capability of the system 100 of being able to locally store packets/content as described above may be advantageous, such as when non-verbal content packets and verbal content packets are received on different channels and/or in a non-simultaneous/delayed/staggered/out-of-order manner. In further embodiments, a channel dedicated for receiving non-verbal packets (ex. —a situational awareness channel) may be tagged with Global Positioning System (GPS) information of other position location capable devices for allowing the system 100 to provide accurate scene of operation recreation. For instance, the system 100 of the present invention may be configured for implementation with multiple remotely located radios/devices for providing collaborative situational awareness recreation. Further, cognitive higher functional processing of situational awareness channels may be performed for informing users of potential problems within the immediate vicinity. For instance, the system 100 may implement a localized situational awareness analyzer for collecting situational awareness information (ex. —non-verbal content) from multiple radios in a local vicinity and searching for/identifying patterns and/or clues which may be indicative of potential ambush probability, sniper location, or the like. Additionally, situational awareness channels may be used as authentication mechanisms, via implementation of speech analysis and/or speech pattern recognition.

The system 100 of the present invention may be configured such that provision of the non-verbal content packets to the encoder/decoder 106 and provision of the verbal content packets to the vocoder 104 occurs in parallel (as shown in FIG. 1). In alternative embodiments of the present invention, the system 100 may be configured with a separate transmitter and receiver, rather than the transceiver 102 described above. In further alternative embodiments of the present invention, the system 100 may be configured with a separate situational awareness encoder and situational awareness decoder, rather than situational awareness encoder/decoder 106 described above.

Figure 3:
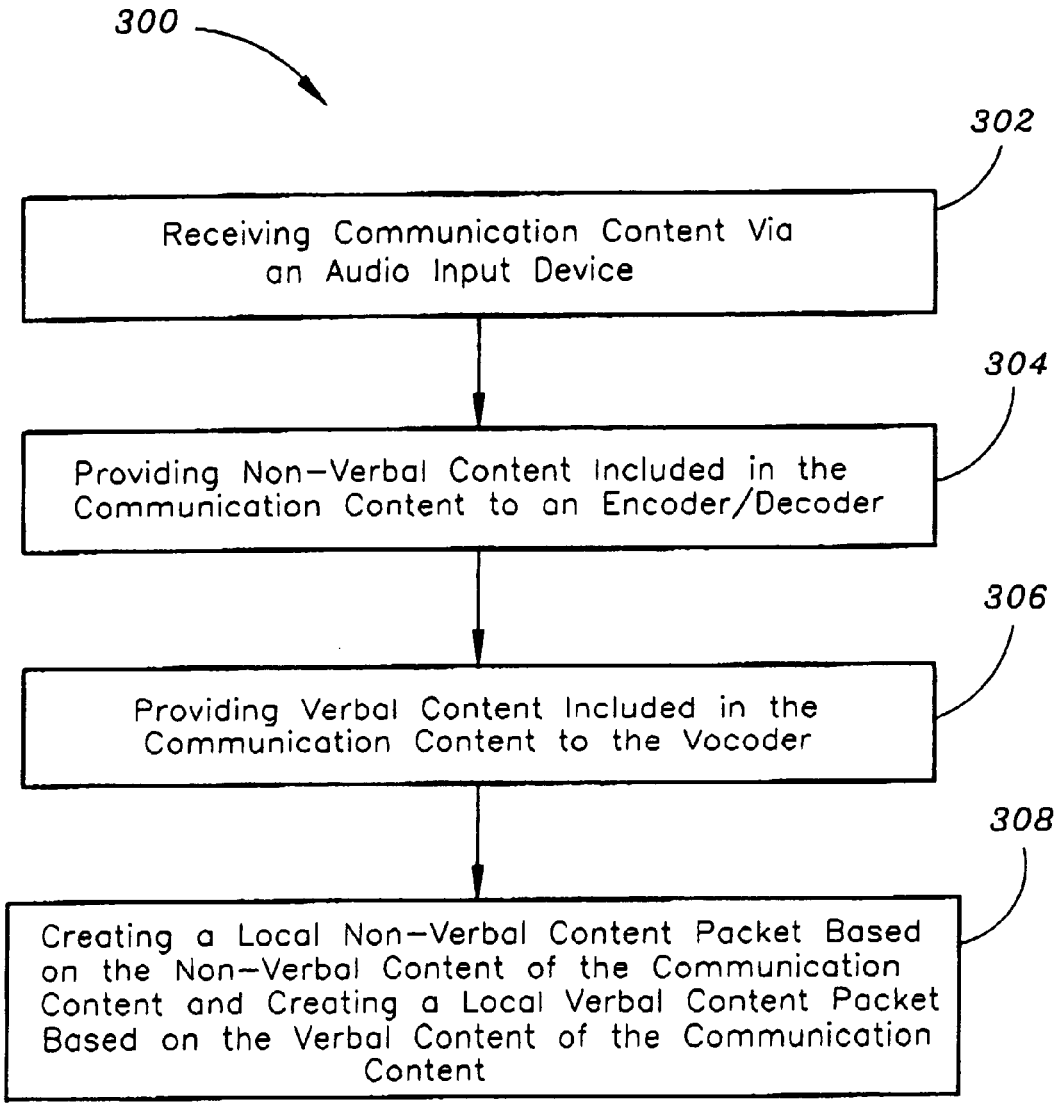
FIG. 3 is a flowchart illustrating a method for promoting situational awareness enhancements for a low bit rate vocoder in accordance with an exemplary embodiment of the present invention.

Referring to FIG. 3, a flow chart illustrating a method for promoting situational awareness enhancements for a low bit rate vocoder in accordance with an exemplary embodiment of the present invention is shown. In a current embodiment of the present invention, the method 300 may include receiving communication content via an audio input device 302. The method 300 may further include providing non-verbal content included in the communication content to an encoder/decoder 304. The method 300 may further include providing verbal content included in the communication content to the vocoder 306. The method 300 may further include creating a local non-verbal content packet based on the non-verbal content of the communication content and creating a local verbal content packet based on the verbal content of the communication content 308.

In current embodiments of the present invention, the method 300 may further include linking the local non-verbal content packet and the local verbal content packet 310. The method 300 may further include transmitting the local non-verbal content packet and the local verbal content packet via a radio communication transceiver 312. For instance, the local non-verbal content packet and the local verbal content packet may be simultaneously transmitted to a remote party/recipient.

In exemplary embodiments, the method 300 may further include receiving a non-verbal content packet and a verbal content packet via the radio communication transceiver 314. The method 300 may further include providing the non-verbal content packet to the encoder/decoder 316. The method 300 may further include providing the verbal content packet to the vocoder 318. The method 300 may further include extracting non-verbal content from the non-verbal content packet and extracting verbal content from the verbal content packet 320. The method 300 may further include providing an output based on the extracted non-verbal content via an output device 322. The method 300 may further include providing an output based on the extracted verbal content via the output device 324.

The system 100 of the present invention, as described above, allows a user of the system to provide/re-create situational awareness in a distortion-free manner based on information received (ex. —non-verbal content/non-verbal content packets and verbal content/verbal content packets) via radio communication from a remote location (ex. —from an originator). Likewise, the system 100 of the present invention is further configured for transmitting information (ex. —local verbal content packets/local non-verbal content packets) in such a manner as to allow recipients to do likewise. The system 100 of the present invention is advantageous in that it may allow for situational awareness information (ex—non verbal content) to be extracted and output to a user of the system in such a manner that said non-verbal content is not distorted and allows for superior situational awareness for the user.

Current communication protocols exchange messages to setup voice or data call sessions. In further embodiments, the system 100 of the present invention may support dynamic selection of situational awareness capability during call setup. For example, a call originator may set an information element indicating the ability to send situational awareness information. The call recipient may respond by accepting the situational awareness (SA) content (ex. —non verbal content/non-verbal content packets) or rejecting the situational awareness content based on user configuration, based on user selection upon being presented with a choice, or based on past history. The call recipient may also set the priority for the SA content and also the communication medium over which it expects the information. The above-described protocol exchange may also permit inter-working with legacy radios that do not have this capability on a per call basis.

In a number of embodiments, it may be that when a call originates there may be no need to exchange/receive/transmit SA content as the situation may be benign (ex. —may be a non-emergency situation). However, during the call, the situation may become tense and may require that SA content be exchanged/transmitted/received. In exemplary embodiments, the ability of the system 100 of the present invention to exchange/receive/transmit SA content may be dynamically enabled/disabled.

In further embodiments, it may be that when a call is initiated, there are no/insufficient resources bandwidth, frequency, channel etc. that permit/allow for SA exchange/receipt/transmission. The system 100 of the present invention may be configured/may provide options for permitting automatic SA exchange/receipt/transmission, such as when sufficient resources become available. Further, in situations when resources become unavailable, the system 100 may be configured for disabling (ex. —automatically disabling) SA exchange/receipt/transmission.

Communication devices with additional SA sensors like cameras, fatigue monitoring devices, health monitoring devices etc. may also be used to provide SA information. There is no need to limit SA information as coming from the speech source.

As part of cognitive warfare, there is no requirement that the SA sensors are directly connected to the radio. They can be a part of the platform (Humvee, boat etc.).

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that the present invention may be conveniently implemented in forms of a software package. Such a software package may be a computer program product which employs a computer-readable storage medium including stored computer code which is used to program a computer to perform the disclosed function and process of the present invention. The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A system for promoting situational awareness enhancement, comprising:

a transceiver configured for receiving a non-verbal content packet and a verbal content packet, both the non-verbal content packet and the verbal content packet being transmitted from a remote source;

a vocoder communicatively coupled with the transceiver, the vocoder being configured for receiving the verbal content packet from the transceiver, the vocoder being further configured for extracting verbal content from the verbal content packet; and a situational awareness encoder/decoder communicatively coupled with the transceiver, the encoder/decoder being configured for receiving the non-verbal content packet from the transceiver, the encoder/decoder being further configured for extracting non-verbal content from the non-verbal content packet;

an audio output device connected to the vocoder and the encoder/decoder, the audio output device configured for providing an audio output based on the extracted non-verbal content and the extracted verbal content; and a visual output device connected to the encoder/decoder, the visual output device configured for providing a text output based on the extracted non-verbal content, wherein provision of the verbal content packet from the transceiver to the vocoder occurs in parallel with provision of the non-verbal content packet from the transceiver to the encoder/decoder, the system linking the verbal content packet with the non-verbal content packet and synchronizing the audio output and the text output.

2. A system as claimed in claim 1, further comprising:

an audio input device communicatively coupled to the vocoder and the encoder/decoder, the audio input device configured for receiving communication content.

3. A system as claimed in claim 2, wherein the vocoder is further configured for receiving verbal content included in the communication content.

4. A system as claimed in claim 3, wherein the vocoder is further configured for generating a local verbal content packet, the local verbal content packet being based on the verbal content of the communication content, and the encoder/decoder is further configured for generating a local non-verbal content packet, the local non-verbal content packet being based on the non-verbal content of the communication content.

5. A system as claimed in claim 4, wherein the transceiver is further configured for transmitting the local non-verbal content packet and the local verbal content packet via radio communication.

6. A system as claimed in claim 4, wherein the system is configured for linking the local verbal content packet and the local non-verbal content packet.

7. A system as claimed in claim 2, wherein the encoder/decoder is further configured for receiving non-verbal content included in the communication content.

8. A system as claimed in claim 2, further comprising:

a storage device communicatively coupled with the encoder/decoder and the transceiver, the storage device configured for storing the local non-verbal content packet, the storage device further configured for storing the non-verbal content packet.

9. A system as claimed in claim 1, wherein the vocoder is a low bit rate vocoder.

10. A method for promoting situational awareness enhancements for a low bit rate vocoder, comprising:

receiving communication content via an audio input device;

providing non-verbal content included in the communication content to an encoder/decoder;

providing verbal content included in the communication content to the vocoder;

creating a local non-verbal content packet based on the non-verbal content of the communication content and creating a local verbal content packet based on the verbal content of the communication content;

linking the local non-verbal content packet and the local verbal content packet via the encoder/decoder, said encoder/decoder implementing packet synchronizers for providing said linking, said linking including creating timestamp linkages for the local non-verbal content packet and the local verbal content packet;

transmitting the local non-verbal content packet and the local verbal content packet via a radio communication transceiver;

receiving a non-verbal content packet and a verbal content packet via the radio communication transceiver;

providing the non-verbal content packet to the encoder/decoder;

providing the verbal content packet to the vocoder, the verbal content packet being provided to the vocoder in parallel with the provision of the non-verbal content packet to the encoder/decoder;

extracting non-verbal content from the non-verbal content packet and extracting verbal content from the verbal content packet;

providing an output based on the extracted non-verbal content via an output device; and providing an output based on the extracted verbal content via the output device.

11. A computer-readable medium having computer-executable instructions for performing a method for promoting situational awareness enhancements for a low bit rate vocoder, said method comprising:

receiving communication content via an audio input device;

providing non-verbal content included in the communication content to an encoder/decoder;

providing verbal content included in the communication content to the vocoder;

creating a local non-verbal content packet based on the non-verbal content of the communication content and creating a local verbal content packet based on the verbal content of the communication content;

linking the local non-verbal content packet and the local verbal content packet via the encoder/decoder, said encoder/decoder implementing packet synchronizers for providing said linking, said linking including creating timestamp linkages for the local non-verbal content packet and the local verbal content packet;

transmitting the local non-verbal content packet and the local verbal content packet via a radio communication transceiver;

receiving a non-verbal content packet and a verbal content packet via the radio communication transceiver;

providing the non-verbal content packet to the encoder/decoder, the verbal content packet being provided to the vocoder in parallel with the provision of the non-verbal content packet to the encoder/decoder;

providing the verbal content packet to the vocoder;

extracting non-verbal content from the non-verbal content packet and extracting verbal content from the verbal content packet;

providing an output based on the non-verbal content via an output device; and providing an output based on the verbal content via the output device.

* * * * *